United States Patent [19]

Lawson

[11] Patent Number: 4,537,356

[45] Date of Patent: Aug. 27, 1985

[54] DRIVE ASSEMBLY FOR A REACTION DRIVE SPRINKLER

[75] Inventor: Kenneth L. Lawson, Ontario, Calif.

[73] Assignee: Rain Bird Sprinkler Mfg. Corp., Glendora, Calif.

[21] Appl. No.: 607,579

[22] Filed: May 7, 1984

[51] Int. Cl.[3] ..... B05B 3/08

[52] U.S. Cl. ..... 239/230; 239/233; 239/248

[58] Field of Search ..... 239/230, 231, 232, 233, 239/246, 248, 229

[56] References Cited

U.S. PATENT DOCUMENTS

| | | | |
|---|---|---|---|
| 2,877,053 | 3/1959 | Kennard | 239/505 |
| 3,091,400 | 5/1963 | Aubert | 239/229 X |
| 3,924,809 | 12/1975 | Troup | 239/230 |
| 4,103,828 | 8/1978 | Ridgway | 239/206 |
| 4,161,286 | 7/1979 | Beamer | 239/230 |
| 4,177,944 | 12/1979 | Wichman | 239/230 |
| 4,235,379 | 11/1980 | Beamer | 239/230 |
| 4,434,937 | 3/1984 | Pitchford | 239/230 |

OTHER PUBLICATIONS

National Rain Bird Sales & Eng. Corp., Model No. 100B Adjustable Nozzle "Instructions For Adjustment", 6-12-61.

National Rain Bird Sales & Eng. Corp., Sales Publication No. 62-A9, Dec. 1962, pp. 21-14 23, 1979-1980, Rain Bird Irrigation Equipment Catalogue.

Johns Manville Sales Publication, Dec. 1977, (Model 211G/221G/250G; 5910).

Simes Sales Publication, "Mod. Farmer"; Mod. Super Farmer.

*Primary Examiner*—Andres Kashnikow

*Assistant Examiner*—David P. Davidson

[57] ABSTRACT

A reaction drive sprinkler includes an improved drive assembly for rotating the sprinkler in steps about a water supply standpipe. The drive assembly comprises a fixed drive nozzle through which an inclined stream of irrigation water is projected for passage through a movable diverter tube mounted in front of the drive nozzle. The diverter tube is shifted by a reversing mechanism for slightly diverting the water stream for alternated interruption by a pair of laterally oppositely angled deflector spoons on a pivoting reaction drive arm. More particularly, the diverter tube directs the water stream for cyclic interruption by one of the deflector spoons to rotate the sprinkler stepwise in one direction through a selected arcuate path and then shifts the diverter tube to direct the water stream for interruption by the other deflector spoon for stepwise sprinkler rotation in the opposite direction.

17 Claims, 9 Drawing Figures

FIG. 1
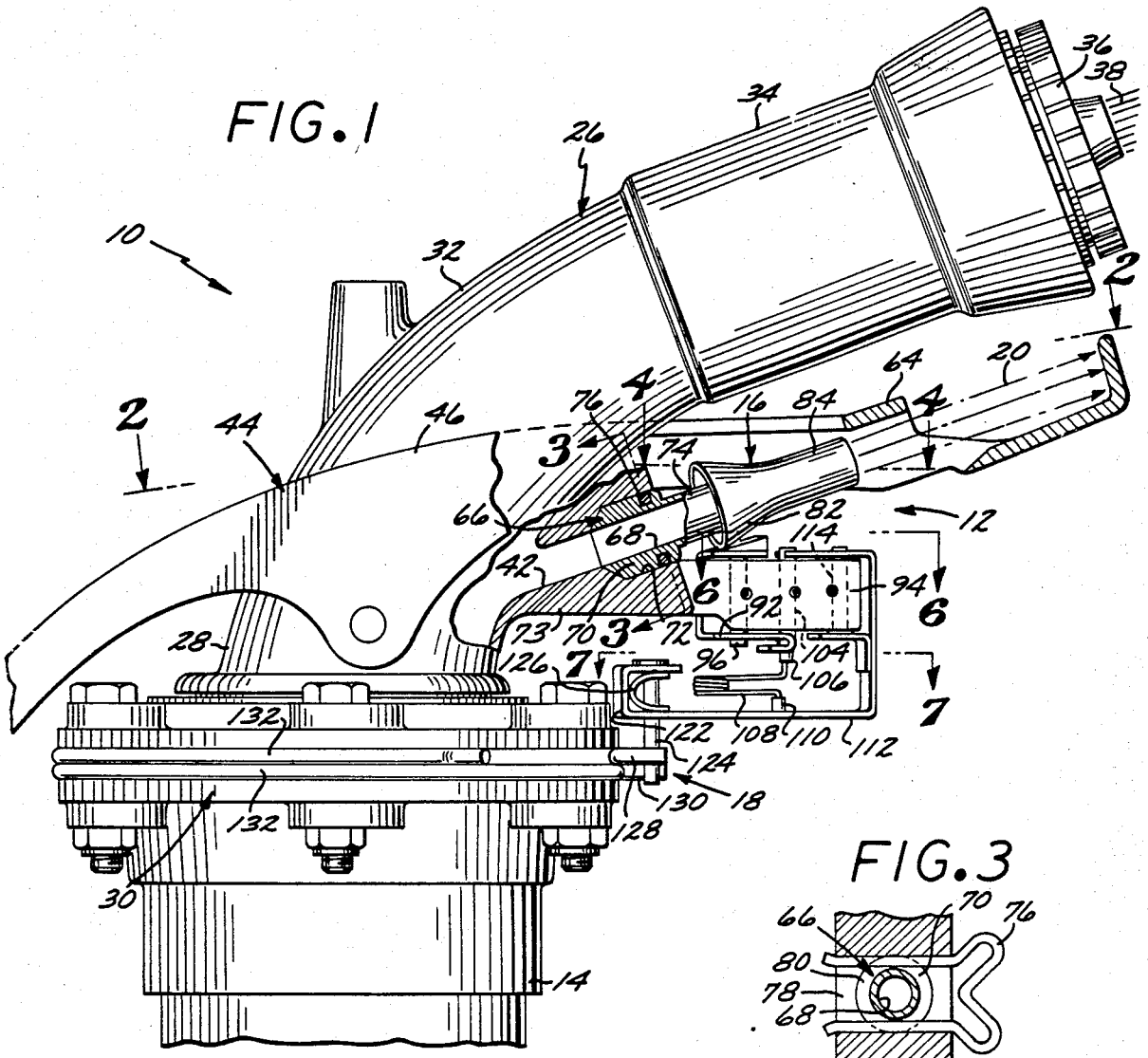
FIG. 3
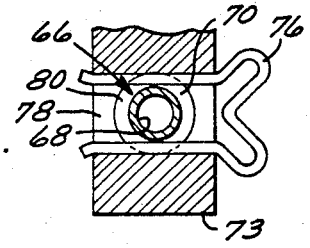
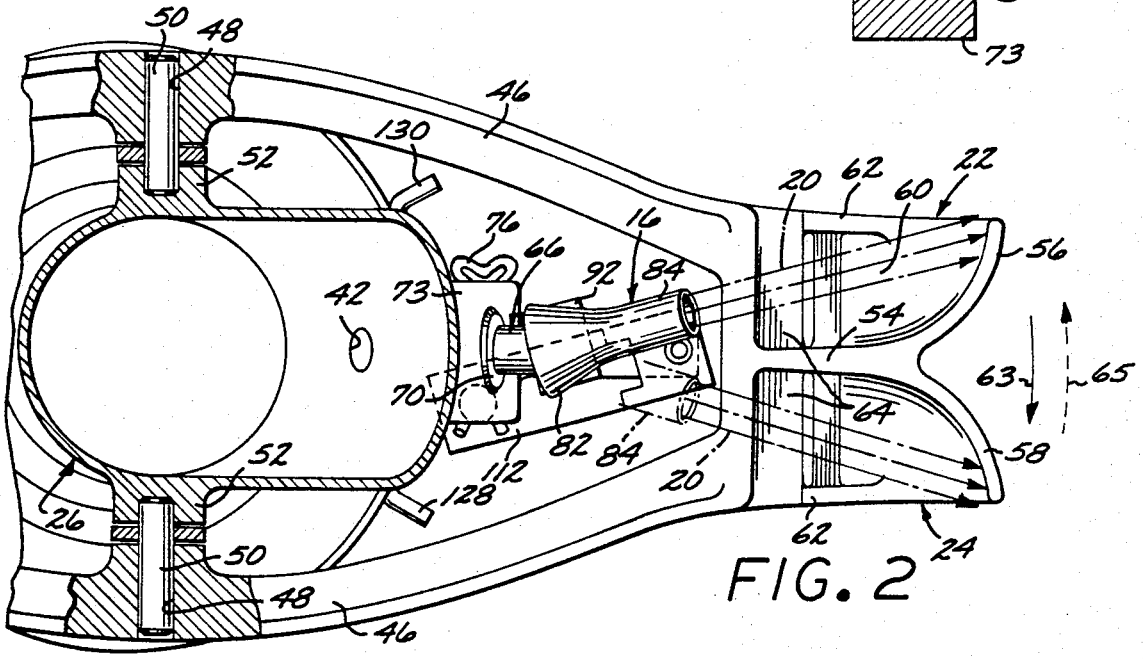
FIG. 2

DRIVE ASSEMBLY FOR A REACTION DRIVE SPRINKLER

BACKGROUND OF THE INVENTION

This invention relates generally to rotatable irrigation sprinklers particularly of the type including a reaction drive member for interacting cyclically with a projected water stream to rotate the sprinkler in steps and thereby alter the azimuthal direction of the water stream. More specifically, this invention relates to an improved drive assembly for a reaction drive sprinkler of the general type disclosed and claimed in U.S. Pat. No. 4,434,937.

Rotatable water sprinklers of the so-called reaction drive type are known in the art for supplying irrigation water over a substantial surface area to irrigate lawns, crops, and the like. Such reaction drive sprinklers typically comprise a sprinkler body supported by a bearing assembly for rotation about the upper end of a water supply standpipe. Irrigation water under pressure supplied through the standpipe flows upwardly through the sprinkler body and is discharged outwardly through a discharge outlet or nozzle with a selected angle or upward inclination. A reaction drive arm is mounted on the sprinkler body for pivoting movement typically within a generally vertical plane and is appropriately counterweighted to swing a laterally open curved deflector spoon cyclically into interrupting engagement with the projected water stream. The water stream interacts with the deflector spoon to swing the spoon away from the stream and further to impart a lateral torque transmitted through the drive arm to the sprinkler body to rotate the sprinkler through a relatively small step, after which the drive arm returns the deflector spoon for subsequent water stream interruption and sprinkler rotation through a subsequent step. Accordingly, the deflector spoon interrupts the water stream in a cyclic fashion to rotate the sprinkler through a series of relatively small steps thereby correspondingly altering the direction of throw of the projected water stream. This stepwise movement can be allowed to continue through repeated full-circle rotations, or alternatively, if desired, a suitable reversing mechanism can be provided to reverse the direction of rotation within the limits of a preselected arcuate path.

Reaction drive water sprinklers of the type described have been used widely in agricultural irrigation systems requiring a relatively high flow water stream to be projected a substantial distance from the sprinkler. In this type of sprinkler, sometimes referred to as a large gun or big gun sprinkler, the deflector spoon interacts with the high energy water stream to drive the sprinkler in steps in one rotational direction. For part-circle operation, a reversing mechanism responds to sprinkler movement reaching one end limit of a selected arcuate path to move a reversing cam into interrupting engagement with the high energy stream. This results in a relatively high reaction force swinging the sprinkler rapidly back through the arcuate path to the other end limit whereupon the reversing cam is retracted from the water stream and normal stepwise rotation by means of the deflector spoon is resumed. Commercial examples of the foregoing type of reaction drive sprinkler are the Model 102 and Model 103 Rain Guns manufactured by Rain Bird Sprinkler Mfg. Corp. of Glendora, Calif. In such reversible reaction drive sprinklers, the provision of a reversing cam and related actuating components undesirably increases the overall cost and complexity of the sprinkler. Moreover, reversing cam engagement with the high energy water stream can cause extremely rapid reversed rotational movement which can in turn contribute to excessive component wear and/or failure of mechanical components. Still further, interruption of the high energy water stream by the deflector spoon and the reversing cam knocks down a portion of the stream thereby effectively reducing sprinkler range.

In U.S. Pat. No. 4,434,937, an improved reaction drive sprinkler is disclosed of the so-called large or big gun type. This improved reaction drive sprinkler includes a relatively large range tube through which a high flow, high energy water stream is projected a substantial distance from the sprinkler, together with a comparatively smaller drive nozzle through which a secondary, significantly lower energy water stream is projected for reversible driving purposes. This lower energy water stream is interrupted in a cyclic manner by one of a pair of oppositely curved deflector spoons carried on a pivoting reaction drive arm, with the drive nozzle being formed from a flexible rubber-based or plastic material movable to aim the lower energy stream for engagement with either deflector spoon in accordance with the desired direction of rotational sprinkler stepping movement. The flexible drive nozzle can thus be set to rotate the sprinkler stepwise through a full-circle path in either direction or the drive nozzle can be switched by a reversing mechanism back and forth to achieve reversible sprinkler stepwise rotation within the limits of a preselected arcuate path. While this use of the relatively low energy stream for driving purposes advantageously results in controlled sprinkler movement in both rotational directions together with reduced component wear, the flexible drive nozzle has not provided consistent drive performance particularly when subjected to varying operating parameters, such as temperature or pressure. For example, variations in these and other parameters can produce widely variant physical characteristics for the lower energy drive stream thereby resulting in unacceptably inconsistent reaction drive forces and sometimes making it difficult to aim the stream for proper interaction with the selected deflector spoon.

There exists, therefore, a significant need for an improved drive assembly for a reaction drive sprinkler of the general type described in U.S. Pat. No. 4,434,937, wherein the improved drive assembly includes means for providing a relatively low energy water stream having substantially consistent drive characteristics and wherein this water stream can be shifted accurately back and forth for controlled interruption by two oppositely oriented deflector spoons. The present invention fulfills these needs and provides further related advantages.

SUMMARY OF THE INVENTION

In accordance with the invention, a reaction drive sprinkler is provided with an improved drive assembly for forming and directing an outwardly projected stream of irrigation water into interrupting engagement with one of two laterally open, oppositely curved deflector spoons on a pivoting reaction drive arm. The drive assembly comprises a fixed drive nozzle through which the water stream is projected, and diverter means movably positioned between the drive nozzle and the deflector spoons for controlled slight diversion of the water stream into reaction engagement with the selected one of the deflector spoons. The diverter means is shifted by a reversing mechanism between a first position diverting the stream for engagement with one of the spoons to drive the sprinkler in one rotational direction and a second position diverting the stream for engagement with the other spoon to drive the sprinkler in the opposite rotational direction.

In one preferred form of the invention, the reaction drive sprinkler includes a sprinkler body adapted for rotatable mounting onto the upper end of a water supply standpipe. The sprinkler body includes a relatively large, outwardly inclined range tube through which a high flow, relatively high energy uninterrupted water flow stream is projected. The drive nozzle is positioned generally along the inside curvature of a range tube elbow portion for bleed discharge of a comparatively lower flow, lower energy water stream for reaction engagement with the deflector spoons. The drive nozzle is fixed in position and formed preferably from an abrasion-resistant long-life material, such as brass or the like, and is supported on the range tube for projecting the low energy stream upwardly and outwardly generally in parallel with the high energy stream discharged from the range tube. The deflector spoons are carried at the forward end of a counter-weighted reaction drive arm mounted on the range tube for pivoting movement through a generally vertical plane. The deflector spoons are defined by oppositely curved, laterally open deflector walls, such that engagement of one of the spoons by the low energy water stream results in a laterally directed force for rotating the sprinkler body in a small rotational step about the axis of the water supply standpipe.

The preferred diverter means comprises a diverter tube supported between the drive nozzle and the deflector spoons. This diverter tube has an enlarged flared inlet end for reception of the low energy water stream discharged from the drive nozzle, wherein this inlet end converges to and merges with a generally cylindrical guide tube through which the low energy stream is projected for impact engagement with the selected deflector spoon. A movable support bracket carries the diverter tube and is shifted by the reversing mechanism between the first and second positions orienting the diverter tube for diverting the low energy stream laterally through a small angle into respective engagement with the two deflector spoons.

The reversing mechanism includes an actuator arm carried by the range tube and operatively coupled by an over-center spring or the like to the support bracket to shift the support bracket between the first and second positions. Trip means on the actuator arm is responsive to sprinkler rotational movement to one of the end limits of a preselected arcuate path of movement to displace the actuator arm thereby shifting the support bracket and diverter tube between the first and second positions.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a fragmented side elevation view of a reaction drive sprinkler, shown partially in vertical section, including the improved drive assembly embodying the novel features of the invention;

FIG. 2 is a fragmented sectional view taken generally on the line 2—2 of FIG. 1;

FIG. 3 is a fragmented sectional view taken generally on the line 3—3 of FIG. 1;

DETAILED DESCRIPTION OF THE PREFERRED EMBODIMENT

Figure 4:
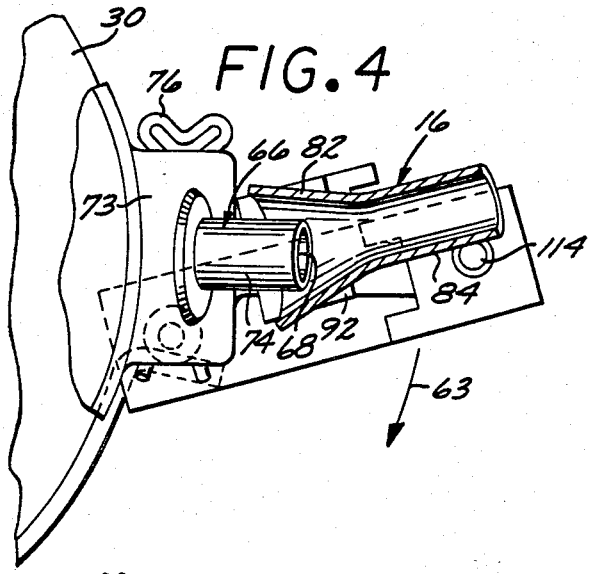
FIG. 4 is a fragmented sectional view through a portion of the drive assembly, taken generally on the line 4—4 of FIG. 1, and depicting the drive assembly in a first operating position.

As shown in the exemplary drawings, a reaction drive sprinkler referred to generally by the reference number 10 includes an improved drive assembly 12 for rotationally stepping the sprinkler in relatively small increments about the axis of a water supply standpipe 14. The drive assembly 12 includes a diverter tube 16 movably positioned by a reversing mechanism 18 for slightly diverting a relatively low energy water stream 20 into driving engagement with a selected one of a pair of oppositely curved deflector spoons 22 and 24 to control the direction of sprinkler stepping movement.

The reaction drive sprinkler 10 corresponds generally with the reaction drive sprinkler disclosed and claimed in commonly assigned U.S. Pat. No. 4,434,937, with the inclusion of the improved drive assembly 12. More particularly, as shown best in FIGS. 1 and 2, the reaction drive sprinkler 10 comprises a sprinkler body of an appropriate metal casting or the like defining a relatively large bore range tube 26 having a lower end 28 rotationally supported by a bearing assembly 30 which in turn is adapted for mounting onto the upper end of the water supply standpipe 14. The lower end 28 of the range tube 26 extends upwardly from the bearing assembly 30 and merges smoothly with a curved elbow portion 32 joined in turn with an outwardly inclined discharge barrel 34 having a range tube nozzle 36 at its discharge end. The range tube 26 is thus rotatable within the bearing assembly 30 about a central axis of the standpipe 14, with the bearing assembly 30 having any convenient construction such as that described and claimed in U.S. Pat. No. 4,434,937 to accommodate such rotation.

Water under pressure supplied to the reaction drive sprinkler 10 flows upwardly through the water supply standpipe 14 and further upwardly through the range tube 26 for outward projection therefrom as a relatively high energy water stream 38 with a selected angle of inclination. This high energy stream 38 is swept over a substantial terrain surface area, by operation of the drive assembly 12 to be described which rotates the sprinkler through a succession of small rotational steps, to irrigate lawns, crops, and the like.

The reaction drive sprinkler 10 is rotatably driven by a relatively low energy water stream discharged from the elbow portion 32 of the range tube 26 and projected as the lower energy stream 20 for cyclic interaction with the deflector spoons 22 and 24. More particularly, a relatively small and inherently relatively low pressure portion of the water flowing through the range tube 26 is passed through a bleed opening 42 disposed along the inside curvature of the range tube elbow portion 32, such that the bleed opening 42 is positioned at a location of substantial water energy losses resulting from localized turbulence and/or vortex swirl within the range tube, as recognized by U.S. Pat. No. 3,924,809. This low energy water passes through the bleed passage and is directed by the improved drive assembly 12 including the diverter tube 16 generally in parallel with the high energy stream 38 toward impact engagement with a selected one of the deflector spoons 22 and 24.

The deflector spoons 22 and 24 are supported at the forward end of a reaction drive arm 44 below the discharge barrel 34 of the range tube 26. The illustrative reaction drive arm 44 includes a pair of arm sections 46 extending rearwardly from the deflector spoons on opposite sides of the range tube 26, whereat the arm sections are shaped to define transversely aligned bores 48 for receiving relatively short pivot pins 50 seated in turn by set screws or the like (not shown) within outwardly open sockets 52 on the range tube 26. From the pivot pins 50, the arm sections 46 extend further rearwardly to a position behind the range tube where they are connected in a known manner to an appropriate counterweight (not shown) of selected mass for normally pivoting the deflector spoons upwardly through a generally vertical plane toward the range tube discharge barrel 34, all as shown and described in U.S. Pat. No. 4,434,937 which is incorporated by reference herein.

The deflector spoons 22 and 24 are defined by a central upstanding divider vane 54 common to both spoons and merging smoothly at its forward end with a laterally oppositely curved pair of upstanding deflector walls 56 and 58. The divider vane 54 and the deflector walls 56, 58 are formed integrally with a lower platform 60 joined to the arm sections 46 by a pair of short side struts 62. Accordingly, the two deflector spoons 22 and 24 are generally upwardly open and further are open in opposite lateral directions to deflect water incident therewith in opposite directions.

In operation, the counterweighted reaction drive arm 44 pivots gravitationally to swing the deflector spoons in an upward direction toward interrupting engagement with the projected low energy water stream 20. Conveniently, as is well known in the art, cross vanes 64 pass laterally between the arm sections 46 for initial engagement by the water stream 20 to pull the spoons relatively sharply in an upward direction for full engagement of the selected spoon 22 or 24 with the water stream. As shown best in FIG. 2, when the drive assembly 12 is positioned to guide the stream 20 for engagement with the spoon 22, the low energy water stream is deflected by the associated curved deflector wall 56 laterally away from the spoon 22 resulting in a reaction force imparted to the spoon and transmitted through the reaction arm 44 to the range tube 26 thereby rotating the range tube through a relatively small anglular increment in the direction of arrow 63 with respect to the standpipe 14. Conversely, when the drive assembly diverts the stream 20 for engagement with the other spoon 24, as depicted by dotted lines in FIG. 2, an oppositely directed reaction force results to rotatably drive the range tube 26 through a small step in the opposite direction represented by arrow 65. In either case, the reaction force also drives the deflector spoons downwardly out of engagement with the water stream 20 against the counterweighted mass, whereupon the drive arm 44 eventually overcomes the downward driving force and swings the spoons back upwardly toward interrupting engagement with the water stream and for reaction driving of the rang tube through a subsequent incremental step.

The improved drive assembly 12 for controlling the direction of the low energy stream 20 comprises a fixed drive nozzle 66 of a durable abrasion-resistant material, such as brass or the like, retained in seated alignment with the bleed opening 42 and defining a rigid nozzle bore 68 through which the low energy water stream 20 is discharged with highly consistent physical characteristics particularly independent of temperature fluctuations. More specifically, as shown in the exemplary drawings, the drive nozzle 66 comprises an enlarged cylindrical base 70 having a generally frustoconical seat surface for sealing and seated engagement within a matingly shaped counterbore 72 formed in an enlarged seat portion 73 through which the bleed opening 42 extends. This nozzle base 70 is formed integrally with an elongated nozzle tube 74 projecting upwardly and outwardly generally in parallel with the discharge barrel 34 of the range tube 26. The drive nozzle 66 is retained in position by a generally U-shaped retainer spring 76 having its legs receivable through a laterally open slot 78 in the range tube locked within an external annular groove 80 in the nozzle base 70, as shown best in FIGS. 1 and 3.

The improved drive assembly 12 further includes the diverter tube 16 formed preferably from a metal such as stainless steel and supported by the reversing mechanism 18 in a position generally between the drive nozzle 66 and the deflector spoons 22 and 24. In the preferred form, this diverter tube 16 has an enlarged or flared inlet end 82 with a diameter somewhat greater than the discharge diameter of the nozzle tube 74 for collecting and receiving the low energy water stream 20 projected from the drive nozzle 66 with an initial direction aimed generally toward the central divider vane 54 common to the two spoons. This flared inlet end 82 of the diverter tube 16 is formed integrally with a generally cylindrical or tubular guide tube 84 from which the low energy stream 20 is guidingly discharged for impact engagement by a selected one of the deflector spoons 22 and 24. More particularly, the reversing mechanism 18 shifts the diverter tube 16 back and forth between the first position represented by solid lines in FIG. 2 for laterally diverting the stream 20 from its normal course through a small angle for impact engagement with the deflector spoon 22 thereby reaction driving the sprinkler in steps in the direction of arrow 63. Alternatively, the reversing mechanism 18 moves the diverter tube 16 to the second position shown in dotted lines in FIG. 2 for slightly laterally diverting the water stream 20 into impact engagement with the deflector spoon 24, thereby reaction driving the sprinkler in the opposite rotational direction as indicated by arrow 65 in FIG. 2. Importantly, in both cases the angle of stream diversion is sufficiently small, say about 10°, to avoid any significant reduction in stream drive energy.

Although the reversing mechanism 18 may take any convenient form, one preferred construction is shown in detail in FIGS. 1 and 4–9. More particularly, the diverter tube 16 is secured as by welding onto the upper end of a support bracket 92 which is in turn pivoted by a pivot pin 96 onto a support arm 94 projecting forwardly from the seat portion 73. The lower end of this support bracket 92 includes a forwardly open, generally U-shaped recess 100 (FIG. 6) bounded by forwardly projecting legs 102 for respectively contacting at the first and second diverter tube positions, respectively, a stop pin 104 on the support arm. The support bracket 92 further carries a downwardly open boss 106 at a position near the forward recess 100 to capture one end of an over-center trip spring 108 having its opposite end captured in an upwardly presented boss 110 on an actuator arm 112.

The actuator arm 112 is pivoted on the support arm 94 by a forward pivot pin 114, with an upper bracket portion of the actuator arm including a rearward recess 116 bounded by rearwardly projecting legs 118 and 120 for respectively contacting the stop pin 104. The actuator arm 112 extends downwardly from the support arm 94 and rearwardly past the lower boss 110 and terminates in a U-shaped end 122 which supports a downwardly extending trip pin 124. Conveniently, a C-shaped clip spring 126 releasably retains the trip pin 124 in a downwardly extending position.

Figure 5:
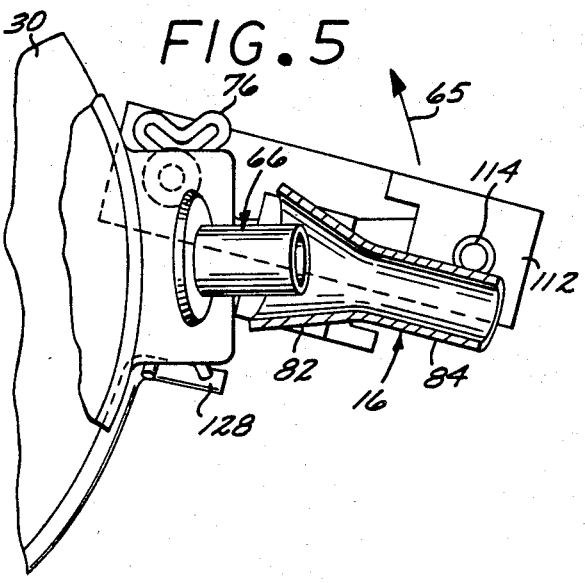
FIG. 5 is a fragmented sectional view similar to FIG. 4 but illustrating the drive assembly in a second operating position.
Figure 6:
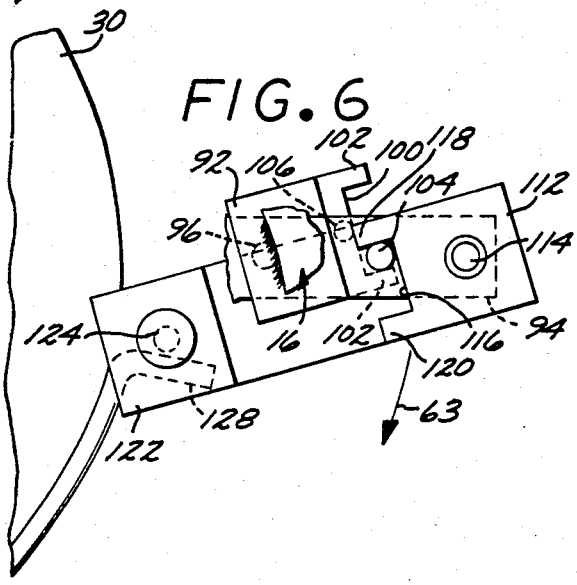
FIG. 6 is a fragmented sectional view of another portion of the drive assembly, taken generally on the line 6—6 of FIG. 1, and depicting the drive assembly in the first operating position.
Figure 8:
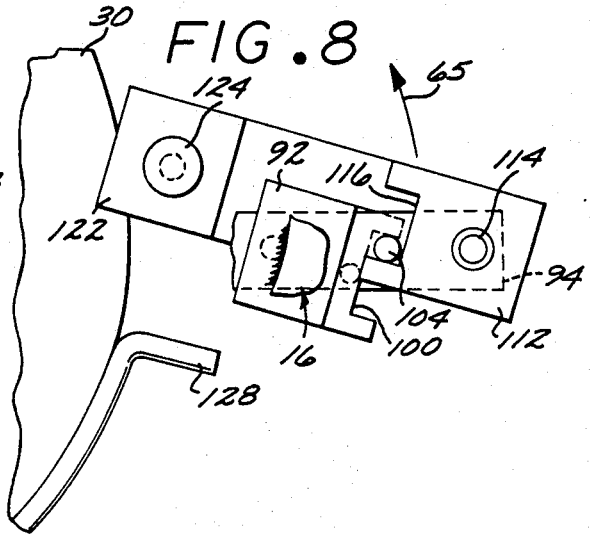
FIG. 8 is a fragmented sectional view similar to FIG. 6 but illustrating the drive assembly in the second operating position.
Figure 7:
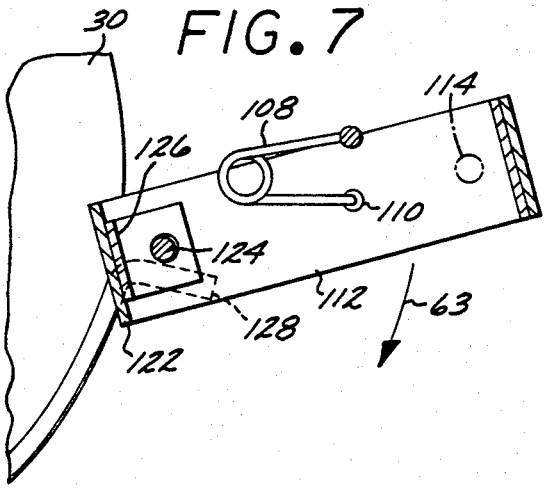
FIG. 7 is a fragmented sectional view through a further portion of the drive assembly, taken generally on the line 7—7 of FIG. 1 and depicting the drive assembly in the first operating position.
Figure 9:
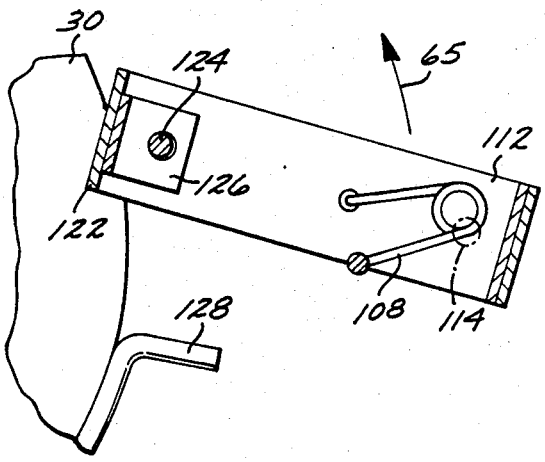
FIG. 9 is a fragmented sectional view similar to FIG. 7 but illustrating the drive assembly in the second operating position.

The trip pin 124 is positioned to engage outwardly projecting tabs 128 and 130 at the ends of clamp springs 132 and 134 wrapped about the bearing assembly 30, wherein these tabs 128 and 130 can be selectively positioned about the circumference of the bearing assembly 30 to define the opposite end limits of a preselected arcuate path within which sprinkler rotation is desired. When the sprinkler rotation in one direction, as depicted by arrow 63, reaches the end limit defined by the tab 128, as viewed in FIGS. 4, 6, and 7, the trip pin 124 engages the tab 128 to pivot the actuator arm 114 relative to the support arm 94, thereby operatively pivoting the support bracket 92 via the trip spring 108 to the second position, as shown in FIGS. 5, 8, and 9. This pivoting movement of the support bracket 92 shifts the diverter tube 16 to the second position for guiding the low energy water stream 20 into interaction with the other deflector spoon 24. When this occurs, rotational stepping movement of the sprinkler reverses and continues in the opposite direction, as indicated by arrow 65, until the trip pin 124 engages the other clamp spring tab 130 thereby activating the reversing mechanism 18 to return the diverter tube 16 to its original first position and against the diurection of stepping motion.

The improved drive assembly 12 thus provides a relatively simple and substantially maintenance free diverter means for shifting the low energy water stream 20 into engagement with the selected deflector spoon 22 or 24 to controllably drive the sprinkler 10 in the desired rotational direction. This controlled directional driving is advantageously accomplished by reliable and consistent drive forces which are not significantly impacted by ambient temperatures, time of service, or other factors.

A variety of modifications and improvements to the improved drive assembly for a reaction drive sprinkler described herein are believed to be apparent to those skilled in the art. Accordingly, no limitation on the invention is intended by way of the description herein, except as set forth in the appended claims.

What is claimed is:

1. A rotatable water sprinkler, comprising:

a range tube having a flow path therethrough for receiving water from a water supply pipe and for discharge projection of the water generally outwardly therefrom, said range tube further defining a relatively small bleed opening for bleed passage of a relatively small water stream from said flow path;

means for rotatably mounting said range tube on the water supply pipe;

a fixed drive nozzle on said range tube for discharge projection of the relatively small water stream outwardly from the sprinkler;

drive means pivoted with respect to said range tube and including first and second oppositely oriented deflector spoons for interrupting engagement with the relatively small water stream to rotatably drive said range tube respectively in opposite rotational directions with respect to the water supply pipe;

diverter means movable between a first position for guiding the relatively small water stream discharged from said drive nozzle in a first direction for interrupting engagement by said first deflector spoon and a second position for guiding said small water stream in a second direction for interrupting engagement by said second deflector spoon; and reversing means responsive to the rotational position of said range tube with respect to the water supply pipe for shifting said diverter means between said first and second positions.

2. The rotatable water sprinkler of claim 1 wherein said diverter means comprises a diverter tube disposed generally in front of said drive nozzle for passage therethrough of the relatively small water stream, said diverter tube slightly diverting the path of the small water stream in said first and second directions when said diverter tube is in said first and second positions, respectively.

3. The rotatable water sprinkler of claim 2 wherein said diverter tube has an outwardly flared inlet end for receiving the small water stream, said inlet end converging into a generally cylindrical guide tube portion for guiding the small water stream toward said first and second deflection spoons.

4. The rotatable water sprinkler of claim 1 wherein said range tube has an inlet end portion for rotatable mounting with respect to the water supply pipe, a discharge barrel portion disposed angularly with respect to said inlet end portion, and a smoothly curved elbow portion between said inlet end and barrel portions, and wherein said bleed opening is formed generally along the inside curvature of said elbow portion.

5. The rotatable water sprinkler of claim 1 wherein said diverter means is pivotally movable with respect to said range tube for movement of said deflector spoons cyclically toward and away from a deflecting position for interruption of the relatively small water stream by one of said spoons, said drive means being biased for movement of said spoons toward said deflecting position.

6. The rotatable water sprinkler of claim 1 wherein said reversing means comprises a pair of brackets mounted on said range tube each for pivoting motion through a limited arcuate path, and a spring reacting between said brackets and responsive to movement of one of the brackets through its associated arcuate path to move the other bracket through its associated arcuate path, one of said brackets being coupled to said diverter means and the other of said brackets being movable back and forth through its associated arcuate path in response to rotational movement of said range tube to an end limit of a preselected arcuate path with respect to said mounting means.

7. The rotatable water sprinkler of claim 6 wherein said reversing means further includes a pair of tabs projecting outwardly from said mounting means at adjustably selected positions to define the end limits of said preselected arcuate path of rotation of said range tube, and a trip pin carried by said other bracket for engaging said tabs for moving said other bracket through its associated arcuate path.

8. A rotatable water sprinkler, comprising:

a range tube for receiving water from a water supply pipe and for discharge of the water in the form of two water streams projected generally in an outward direction with respect to the supply pipe;

means for mounting said range tube to the water supply pipe for rotation with respect thereto and for receiving water therefrom;

a drive nozzle mounted on said range tube for discharge passage of one of said water streams;

drive means pivoted with respect to said range tube and including oppositely oriented deflector spoons for respective interruption of said one stream for driving said range tube respectively in opposite rotational directions about the water supply pipe;

diverter means generally between said drive nozzle and said deflector spoons and movable between a first position diverting said one stream for interruption by one of said spoons and a second position diverting said one stream for interruption by the other of said spoons; and a reversing mechanism for moving said diverter means between said first and second positions.

9. The rotatable water sprinkler of claim 8 wherein said diverter means comprises a diverter tube for passage and slight angular diversion of said one stream in a first direction when said diverter tube is in said first position and a second direction when said diverter tube is in said second position.

10. The rotatable sprinkler of claim 8 wherein said range tube has an inlet end portion for rotation mounting with respect to the supply pipe, a discharge barrel portion disposed angularly with respect to said inlet end portion, and a smoothly curved elbow portion between said inlet end and barrel portions and cooperating therewith to define a flow path for passage of water from the supply pipe, said elbow portion having a bleed opening generally along the inside curvature thereof, said two water streams being discharged respectively from said bleed opening and from said discharge barrel portion.

11. A rotatable water sprinkler, comprising:

a range tube having an inlet end portion and a discharge barrel portion disposed angularly with respect to each other, and an elbow portion connected between said inlet end and barrel portions and cooperating therewith to define a flow path for passage of water through said range tube and projection therefrom as a relatively large water stream, said range tube further including a bleed opening formed generally at the inside curvature of said elbow portion for bleed passage and outward projection of a relatively small portion of the water in the flow path as a relatively small water stream;

a diverter tube mounted on said range tube for receiving the small water stream projected from the bleed opening, said diverter tube being movable between first and second positions for diverting the relatively small water stream respectively in two directions;

a drive arm pivoted to said range tube and including two oppositely oriented deflector spoons, one of said spoons being for interrupting the relatively small water stream when said diverter tube is in said first position resulting in reaction forces to rotate said range tube in one direction with respect to said bearing assembly, and the other of said spoons being for interrupting the relatively small water stream when said diverter tube is in said second position resulting in reaction forces to rotate said range tube in an opposite direction; and a reversing mechanism for switching said diverter tube from said first position to said second position at one end limit of a preselected arcuate path of rotation of said range tube with respect to said bearing assembly and for switching said diverter tube from said second position to said first position at the other end limit of said preselected arcuate path of rotation.

12. In a rotatable water sprinkler having a range tube for rotatable connection with respect to a water supply pipe to receive water from the supply pipe and to project the water in the form of at least one water stream in a generally outward direction with a selected angle of inclination with respect to the supply pipe, a drive assembly, comprising:

reaction drive means including a drive arm pivoted with respect to the range tube and supporting a pair of generally oppositely disposed deflector spoons for selectively interrupting the projected water stream respectively to drive the range tube in opposite rotational directions;

nozzle means mounted on the range tube for discharge passage of the water stream;

diverter means positioned generally between said nozzle means and said deflector spoons and movable between a first position directing the water stream in a first direction for interrupting engagement with one of said deflector spoons and a second position directing the water stream in a second direction for interrupting engagement with the other of said deflector spoons; and means for shifting said diverter means between said first and second positions.

13. The drive assembly of claim 12 wherein said diverter means comprises a diverter tube for receiving the water stream and for slightly diverting the water stream in said first and second directions.

14. The drive assembly of claim 13 wherein said diverter tube has an outwardly flared inlet end for receiving the water stream.

15. The drive assembly of claim 13 wherein said nozzle means comprises a fixed drive nozzle.

16. The drive assembly of claim 13 wherein said shifting means comprises a reversing mechanism including means responsive to rotational movement of the range tube to an end limit of a preselected arcuate path relative to the supply pipe for shifting said diverter means between said first and second positions.

17. The drive assembly of claim 13 wherein said shifting means includes spring means for releasably retaining said diverter means in each of the first and second positions.

* * * * *